US007080515B2

(12) United States Patent
Wasif et al.

(10) Patent No.: US 7,080,515 B2
(45) Date of Patent: Jul. 25, 2006

(54) GAS TURBINE CAN ANNULAR COMBUSTOR

(75) Inventors: Samer P. Wasif, Oviedo, FL (US); Udo Schmitz, Muelheim (DE); Robert Bland, Oviedo, FL (US); Karsten Jordan, Essen (DE); John Carl Glessner, Oviedo, FL (US); J. Scott Markovitz, Sanford, FL (US); Bernd Prade, Muelheim (DE); David Kargetta, New Smyrna Beach, FL (US); Stephen Ramier, Oviedo, FL (US); Stefan Dahlk, Kuerten-Bechen (DE)

(73) Assignee: Siemens Westinghouse Power Corporation, Orlando, FL (US)

( * ) Notice: Subject to any disclaimer, the term of this patent is extended or adjusted under 35 U.S.C. 154(b) by 89 days.

(21) Appl. No.: 10/667,263

(22) Filed: Sep. 19, 2003

(65) Prior Publication Data

US 2005/0016178 A1 Jan. 27, 2005

Related U.S. Application Data

(60) Provisional application No. 60/436,228, filed on Dec. 23, 2002.

(51) Int. Cl.
*F02C 3/00* (2006.01)
*F23R 3/04* (2006.01)
*F23R 3/14* (2006.01)

(52) U.S. Cl. ..... 60/737; 60/748; 60/752; 60/755; 60/760

(58) Field of Classification Search ..... 60/737, 60/742, 746, 747, 748, 752, 754, 755, 756, 60/758, 760

See application file for complete search history.

(56) References Cited

U.S. PATENT DOCUMENTS

| | | | | |
|---|---|---|---|---|
| 3,866,413 | A * | 2/1975 | Strugess | 60/748 |
| 4,112,676 | A * | 9/1978 | DeCorso | 60/737 |
| 4,263,780 | A * | 4/1981 | Stettler | 60/748 |
| 4,265,085 | A | 5/1981 | Fox et al. | |
| 4,322,945 | A | 4/1982 | Peterson et al. | |
| 5,094,069 | A * | 3/1992 | Boffo | 60/760 |
| 5,237,812 | A | 8/1993 | Mumford | |
| 5,271,219 | A * | 12/1993 | Richardson | 60/756 |
| 5,319,936 | A | 6/1994 | Ikeda et al. | |
| 5,359,847 | A | 11/1994 | Pillsbury et al. | |
| 5,396,759 | A | 3/1995 | Richardson | |
| 5,400,587 | A | 3/1995 | Keller et al. | |
| 5,450,725 | A * | 9/1995 | Takahara et al. | 60/737 |

(Continued)

FOREIGN PATENT DOCUMENTS

EP 0 810 405 A2 12/1997

(Continued)

*Primary Examiner*—Ted Kim

(57) ABSTRACT

A gas turbine engine (120) includes a cylindrical basket (146) having an axis (14) and a single main burner assembly (12) disposed within the basket. A burner insert (34) is disposed in an annular space between the burner assembly and the basket. The insert includes a face perpendicular to the axis of the basket. A plurality of passageways (114) are formed in the basket, positioned proximate to and downstream of the burner insert for allowing passage of a portion of an oxidizer flow (42) into a combustion chamber (30). A fluid flow path (38), defined between a combustion chamber liner portion (32) of the basket and a casing (40) spaced radially outward from the combustion liner portion, discharges a fluid into a flow reversal region (118) proximate an inlet (20) of the burner assembly. A fuel outlet (44) is disposed in the flow reversal region.

15 Claims, 5 Drawing Sheets

U.S. PATENT DOCUMENTS

| | | | | | |
|---|---|---|---|---|---|
| 5,491,970 | A | | 2/1996 | Davis, Jr. et al. | |
| 5,540,056 | A | * | 7/1996 | Heberling et al. | 60/737 |
| 5,623,826 | A | | 4/1997 | Ohtsuka et al. | |
| 5,623,827 | A | * | 4/1997 | Monty | 60/748 |
| 5,713,206 | A | * | 2/1998 | McWhirter et al. | 60/737 |
| 5,722,230 | A | | 3/1998 | Cohen et al. | |
| 5,765,376 | A | * | 6/1998 | Zarzalis et al. | 60/748 |
| 5,822,992 | A | | 10/1998 | Dean | |
| 5,901,555 | A | * | 5/1999 | Mandai et al. | 60/737 |
| 5,943,866 | A | | 8/1999 | Lovett et al. | |
| 5,956,955 | A | | 9/1999 | Schmid | |
| 5,974,781 | A | | 11/1999 | Correa et al. | |
| 6,035,645 | A | * | 3/2000 | Bensaadi et al. | 60/748 |
| 6,038,861 | A | | 3/2000 | Amos et al. | |
| 6,070,411 | A | | 6/2000 | Iwai et al. | |
| 6,082,111 | A | | 7/2000 | Stokes | |
| 6,109,038 | A | * | 8/2000 | Sharifi et al. | 60/737 |
| 6,351,947 | B1 | * | 3/2002 | Keller et al. | 60/725 |
| 6,546,733 | B1 | * | 4/2003 | North et al. | 60/756 |
| 6,871,501 | B1 | * | 3/2005 | Bibler et al. | 60/755 |
| 2001/0024774 | A1 | | 9/2001 | Berenbrink | |

FOREIGN PATENT DOCUMENTS

| | | |
|---|---|---|
| EP | 1 223 383 A1 | 7/2002 |
| WO | WO 90/04196 | 1/1999 |
| WO | WO 99/17057 A1 | 4/1999 |

* cited by examiner

GAS TURBINE CAN ANNULAR COMBUSTOR

This application claims the benefit of U.S. Provisional Application 60/436,228 filed Dec. 23, 2002.

FIELD OF THE INVENTION

This invention relates to the field of gas turbine engines, and more particularly, to a can combustor for use in a gas turbine engine.

BACKGROUND OF THE INVENTION

Gas turbine engines are known to include a compressor for compressing air; a combustor for producing a hot gas by burning fuel in the presence of the compressed air produced by the compressor, and a turbine for expanding the hot gas to extract shaft power. The combustion process in many older gas turbine engines is dominated by diffusion flames burning at or near stoichiometric conditions with flame temperatures exceeding 3,000° F. Such combustion will produce a high level of oxides of nitrogen (NOx). Current emissions regulations have greatly reduced the allowable levels of NOx emissions, requiring improvements in combustors to reduce undesirable NOx production.

Gas turbine engines using annular combustion systems typically include a plurality of individual burners disposed in a ring about an axial centerline for providing a mixture of fuel and air to an annular combustion chamber disposed upstream of the annular turbine inlet vanes. The combustion process of the several burners will interact in the combustion chamber since all burners discharge the combustible mixture to the single annulus. Consequently, combustion processes in one burner may affect the combustion processes in the other burners. Other gas turbines use can-annular combustors wherein individual burner cans feed hot combustion gas into respective individual portions of the arc of the turbine inlet vanes. Each can includes a plurality of main burners disposed in a ring around a central pilot burner, as illustrated in U.S. Pat. No. 6,082,111. Can annular combustors are generally more expensive to fabricate as a result of the use of multiple burners within each of the multiple combustor cans which may include cross flame tubes connecting combustor baskets.

The demand to decrease exhaust emissions continues, thus improved techniques for economically controlling the combustion conditions of a gas turbine engine are needed.

BRIEF DESCRIPTION OF THE DRAWINGS

The invention will be more apparent from the following description in view of the drawings that show.

DETAILED DESCRIPTION OF THE INVENTION

Figure 1:
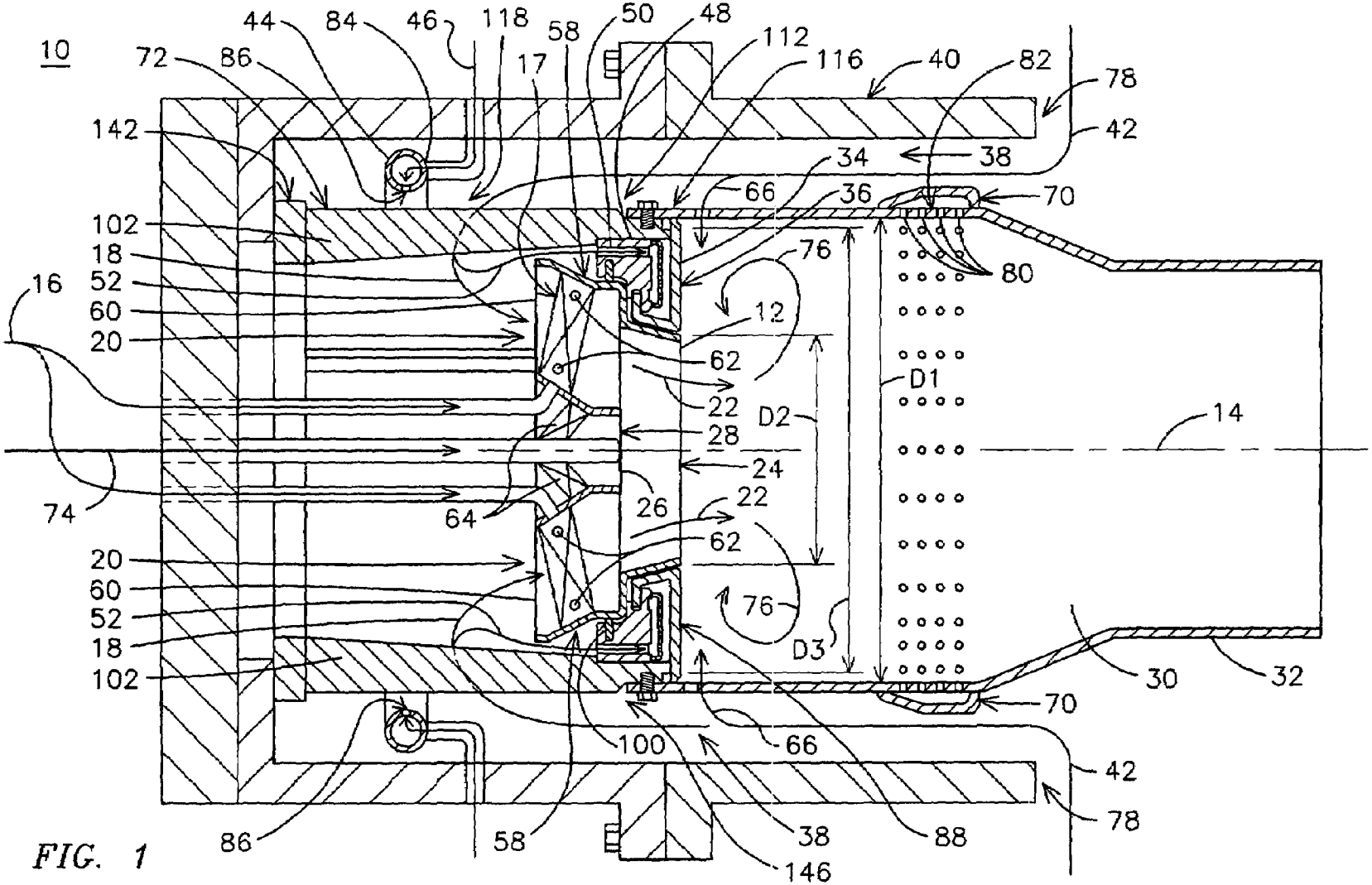
FIG. 1 is an axial cross-sectional view of a gas turbine engine combustor as seen along the direction of flow through the combustor.
Figure 2:
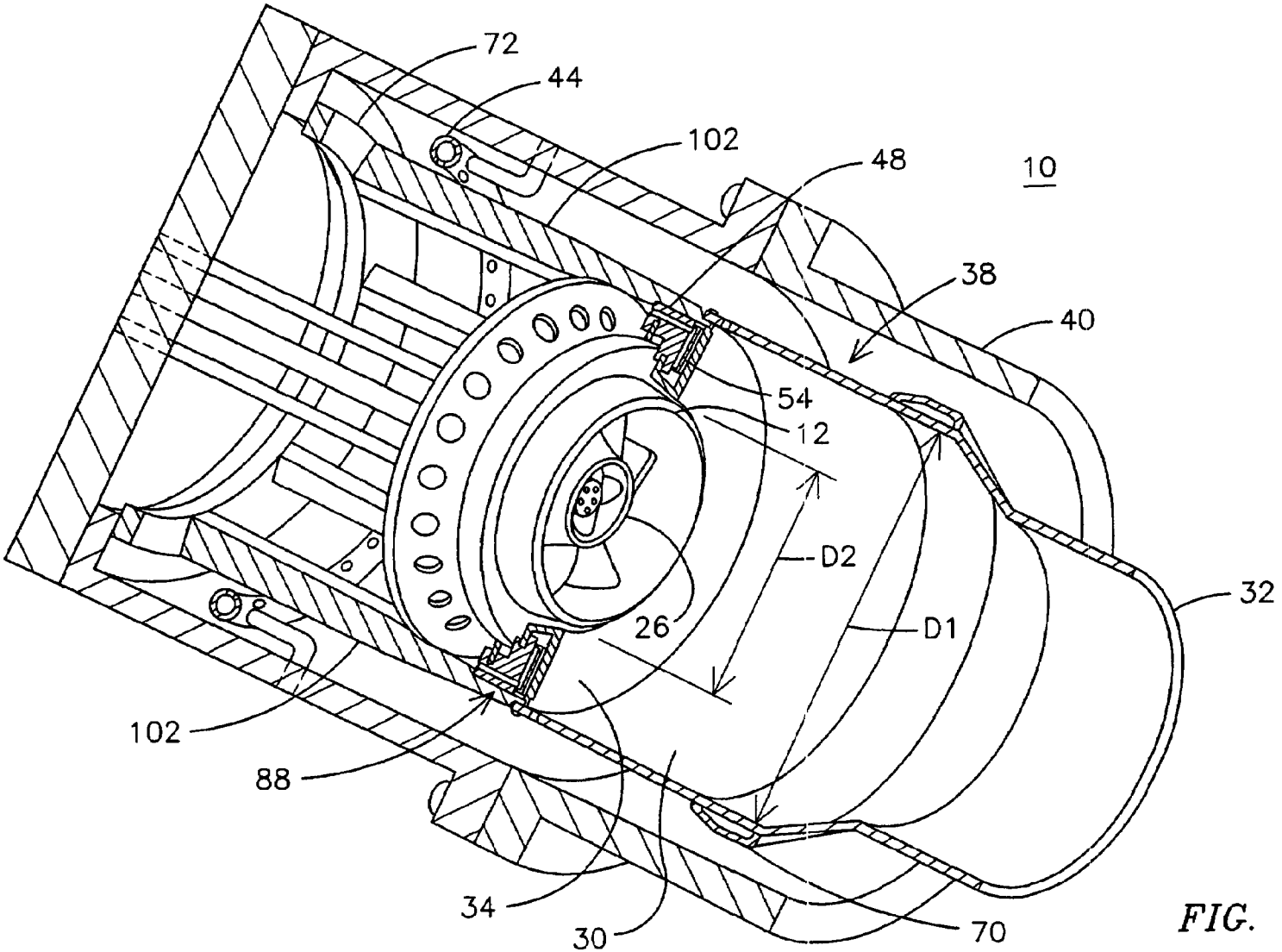
FIG. 2 is a cut-away perspective view of the gas turbine engine combustor of FIG. 1.

FIG. 1 illustrates a cross section of an improved gas turbine engine featuring a combustor 10 having only one main burner 12. FIG. 2 is a cut-away perspective view of the can annular combustor 10 of FIG. 1. Generally, the combustor 10 includes a combustor basket 146, the single main burner 12 disposed within the basket 146, and a casing 40 surrounding and spaced away from the basket 146. The basket 146 may further include a downstream combustion chamber liner 32 and an upstream liner support 72.

In conventional can annular gas turbine engine configurations, each combustor typically includes a plurality of main burners disposed in a ring around a pilot burner. However, such can annular combustors are generally more complex and expensive to fabricate and maintain because of the use of multiple burners within each of the combustors. The inventors of the present invention have innovatively recognized that a single main burner 12, instead of a plurality of burners, can reduce the complexity and expense of fabricating a can annular combustor, while additionally providing reduced NOx emissions.

In an aspect of the invention, the single main burner 12 includes a single main burner swirler 58. The main burner swirler 58 includes mixing vanes 60 having fuel injection openings 62 for providing a flow of a fuel/oxidizer mixture 22 into a combustion chamber 30. The combustion chamber 30 is defined by the combustion chamber liner 32 positioned downstream of the main burner 12 and receives the fuel/oxidizer mixture 22 from the main burner 12. The combustion chamber liner 32 has a larger inside diameter, D1, than a diameter, D2, of the outlet end 24 of the main burner 12, thereby forming an annular space between the main burner 12 and the combustion chamber liner 32. Each combustor 10 may also include a central pilot burner 26, wherein pilot fuel 74 may be premixed with an oxidizer, such as air, and passed through pilot mixing vanes 64 to provide a stable, low emission pilot flame near an outlet end 24 of the main burner 12. The central pilot burner 26 may be operated as a diffusion burner, a partially premixed burner, or a premixed burner. For example, the pilot burner 26 may be operated as a diffusion burner at low turbine load conditions, and operated as a premix burner at high turbine load conditions.

The main burner 12 is positioned within the liner support 72. The liner support 72 may be attached to the casing 40, for example, at an upstream end 142. The liner support 72 may include a number of spaced apart struts 102, so that a first portion of the oxidizer flow 18 can flow through the liner support 72 in a flow reversal region 118. The combustion chamber liner 32 may be attached to the liner support 72 with removable fasteners, for example, by bolting an upstream end 116 of the liner 32 to a downstream end 112 of the support 72, for ease of installation and removal.

The combustion chamber liner 32 may further be provided with one or more resonators 70 for damping combustion pressure oscillations within the combustion chamber 32. For example, the resonator 70 may include a number of resonator openings 80 in the combustion chamber liner 32 in fluid communication with a resonator cavity 82 positioned around an exterior portion of the combustion chamber liner 32. In another aspect, the resonator 70 may extend circumferentially around the combustion chamber liner 32 downstream of the outlet end 24.

The combustor 10 of FIG. 1 may further include an oxidizer flow path 38 defined by the casing 40 disposed around and spaced away from the main burner 12 and the combustion chamber liner 32. The oxidizer flow path 38 is configured to receive an oxidizer flow 42, such as compressed air, at an upstream end 78 of the flow path 38 and discharge a first portion of the oxidizer flow 18 into a flow reversing region 118 near an inlet end 20 of the main burner 12. Accordingly, in the flow reversing region 118, the first portion of the oxidizer flow 18 discharged from the flow path 38 is turned to flow in a direction 180 degrees opposite from a flow direction in the flow path 38.

A fuel outlet 44, such as a fuel injection ring, or a "tophat" type fuel injector, as known in the art, may be positioned in the flow reversing region 118 for premixing a secondary fuel flow 46 into the oxidizer flow 42 before it is delivered to the main burner 12. The fuel outlet 44 may include an annular ring having an inlet opening 84 for receiving the secondary fuel flow 46, and a plurality of outlet openings, for example, circumferentially distributed in the fuel outlet 44, for discharging the secondary fuel flow 46 into the oxidizer flow 42.

The inventors have discovered that positioning of the fuel outlet 44 in the flow reversing region 118 near the inlet end 20 of the main burner 12 provides a less restricted flow around the fuel outlet 44 than placing the fuel outlet 44, for example, near the upstream end 78 of the oxidizer flow path 38. This position advantageously results in a smaller pressure differential between the oxidizer flow 42 upstream of the fuel outlet 44 and downstream of the fuel outlet 44 compared to a position of the fuel outlet 44 in an area of the flow path 38 having a smaller cross sectional area than the flow reversing region 118. Accordingly, positioning of the fuel outlet in the flow reversing region can minimize oxidizer flow 42 pressure build-up upstream of the fuel outlet 44.

In an aspect of the invention, an essentially flat (i.e. perpendicular to the axial direction of airflow) burner insert assembly 88 is provided at the outlet end 24 of the main burner 12 to prevent the oxidizer flow 38 from bypassing the main 12 burner. The flat geometry of the burner insert assembly 88 provides an abrupt diameter change from the outlet end 24 of the main burner 12 to the combustion chamber 30, which causes a flow vortex 76 just downstream of the burner insert assembly 88 within the combustion chamber 30. The flow vortex 76 promotes mixing and appears to improve combustion performance. The inventors have experimentally determined that the flat geometry of the burner insert assembly 88 advantageously provides reduced NOx formation compared to other geometries, such as a tapered shape.

Figure 3:
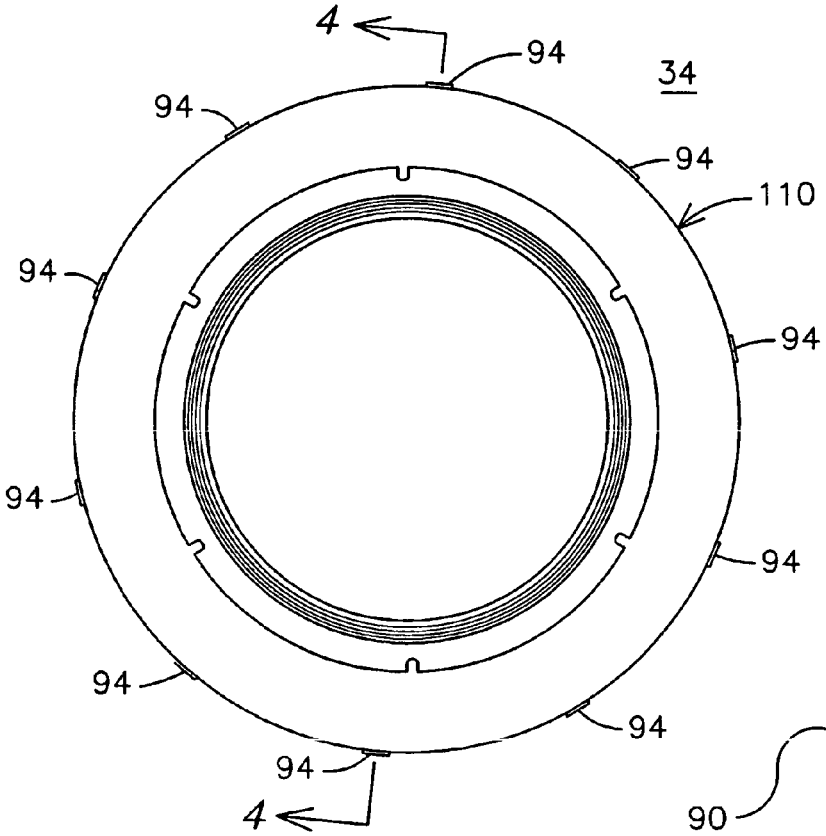
FIG. 3 is a plan view of a burner insert for a gas turbine engine combustor.
Figure 4:
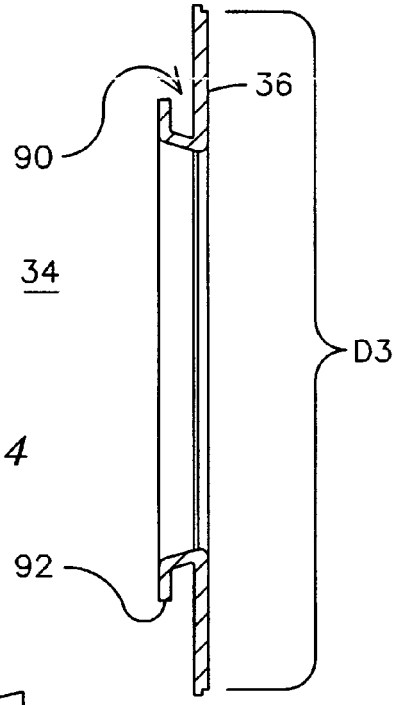
FIG. 4 is a cross-sectional view of the burner insert of FIG. 2 as seen along plane 4—4 of FIG. 3.

In one form, the burner insert assembly 88 may be constructed of two portions—an annular burner insert 34 having a hot side surface 36 that is exposed to the hot combustion gas, and a burner insert support 48 that is protected from the hot combustion products produced in the combustion chamber 30. FIG. 3 is a plan view of one such burner insert 34 and FIG. 4 is a cross-sectional view of the same insert as seen along plane 4—4 of FIG. 3. The insert 34 of FIGS. 3 and 4 is supported in position in a gas turbine combustor 10 by the insert support 48 illustrated in FIG. 5. The insert 34 is a relatively simple geometry that can be relatively inexpensive to manufacture. The insert 34 is easily removed from the insert support 48 and replaced in the event of combustion-induced damage or wear with minimal disassembly of the combustor 10. In particular, if the liner 32 is bolted to the liner support 72, no welding needs to be broken to replace the insert 34. The insert support 48 is protected from the combustion environment by the burner insert 34. The insert support 48 is designed for an extended period of operation without the need for replacement. The insert support 48 may be a relatively expensive component to manufacture because it utilizes cast shapes and extensive machining. The insert 34 and the insert support 48 may be formed of different materials in order to optimize the value of the respective component. Thus, it is only the inexpensive, easily removable component, the burner insert 34 that is exposed to the combustion environment.

The burner insert 34 may be formed from a heat resistant material alloy, such as Hastelloy® (a registered trademark of Haynes International, Incorporated) or other high temperature nickel-based or cobalt-based alloy, and the hot side surface 36 may be coated with a heat resistant material such as a thermal barrier coating (TBC) to withstand hot combustion products in the combustion chamber 30. In one aspect, the TBC may be about 1.6 mm thick. The burner insert 34 may have a generally "J" shaped cross-section 90 forming a circumferential mounting lip 92 for attaching the burner insert 34 to the support 48. The outside diameter, D3, of the burner insert 34 may be slightly smaller than the inside diameter D1 of the combustion chamber liner 32 so that a second portion of the oxidizer flow 42 can flow into the combustion chamber 30 around the burner insert 34. For example, D3 may be about 0.4 millimeters (0.016 inches) less than D1. The burner insert 34 may also include a number of raised spacing tabs 94 extending a radial distance further than the outside diameter, D3, of the burner insert 34, and spaced apart around the outer periphery 110 of the burner insert 34 for keeping the burner insert spaced away from the inside diameter, D1, of the combustion chamber liner 32. For example, each spacing tab 94 may extend a radial distance of 0.2 millimeters (0.008 inches) further than D3.

Figure 5:
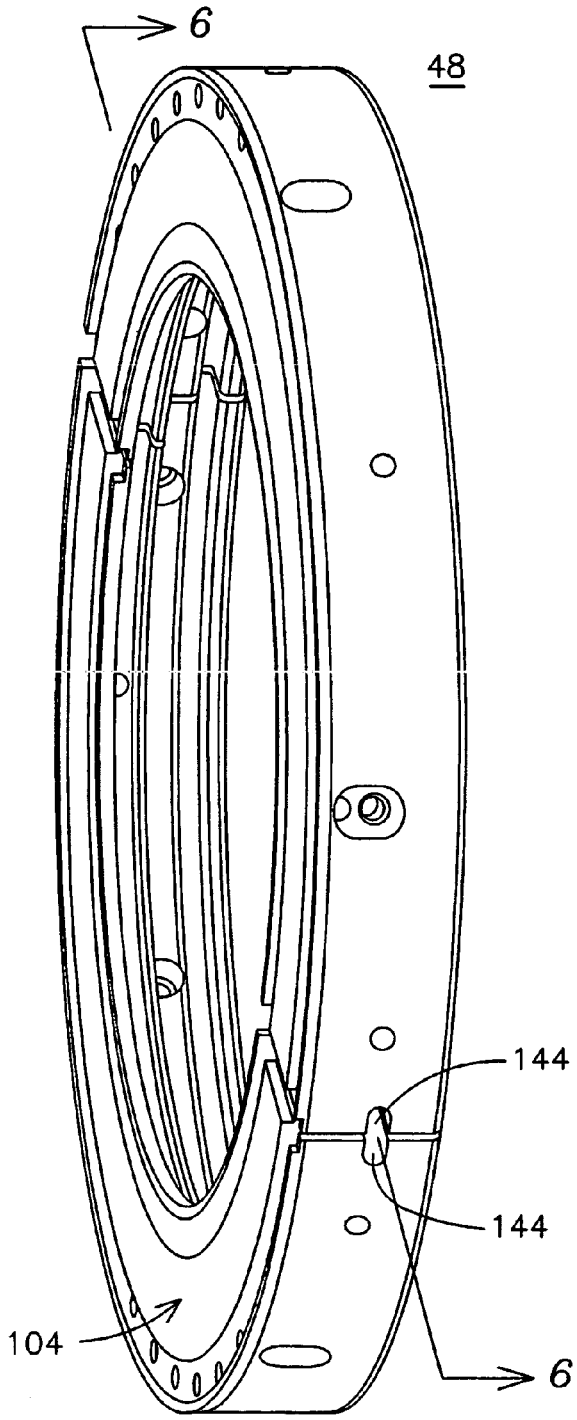
FIG. 5 is a perspective view of an insert support for use with the burner insert of FIG. 3.
Figure 6:
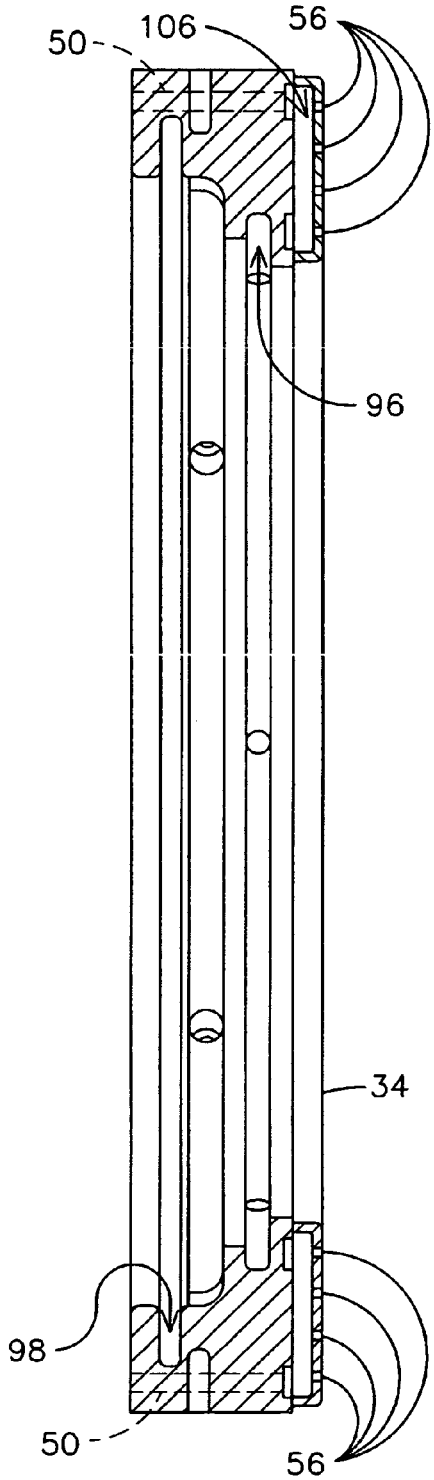
FIG. 6 is a cross-sectional view of the insert support of FIG. 5 as seen along plane 6—6 of FIG. 5.

The burner insert support 48, depicted in FIGS. 5 and 6, supports the burner insert 34 by receiving the mounting lip 92 of the burner insert 34 in a mounting recess 96 formed in the burner insert support 48. In an embodiment, the burner insert support 48 may be constructed of two portions, connectable, for example, along section line 6—6, so that the burner insert support 48 can be easily disassembled for removal and replacement of the burner insert 34. Each portion may include a connection seal recess 144 for accepting a seal (not shown) for sealing between mating surfaces where the two portions are joined. The burner insert support 48 may also include a seal recess 98 for receiving a seal 100 to seal around the main burner 12 as shown in FIG. 1. To provide cooling for the burner insert 34, the burner insert support may include a number of cooling passages 50 oriented parallel with a direction of axial flow and spaced around the periphery 110 of the insert support 48 for conveying a second portion of the oxidizer flow 52.

The insert support 48 may further include an impingement plate 54 as shown in FIG. 6. The impingement plate 54 includes impingement cooling holes 56 for allowing passage of the second portion of the oxidizer flow 52 therethrough to provide impingement cooling of the burner insert 34. The impingement plate 54 is attached, for example, by welding, to the downstream face 104 of the insert support 48, and may be spaced away from the insert support 48 to form an impingement cooling plenum 106 between the impingement plate 54 and the downstream face 104 of the burner insert support 48. Accordingly, the second portion of the oxidizer flow 52 may pass through the internal cooling passages 50 of the insert support 48 into the impingement cooling plenum 106, and then through the impingement cooling holes 56 to impinge upon an upstream face 68 of the burner insert 34 to cool the insert 34.

Figure 7:
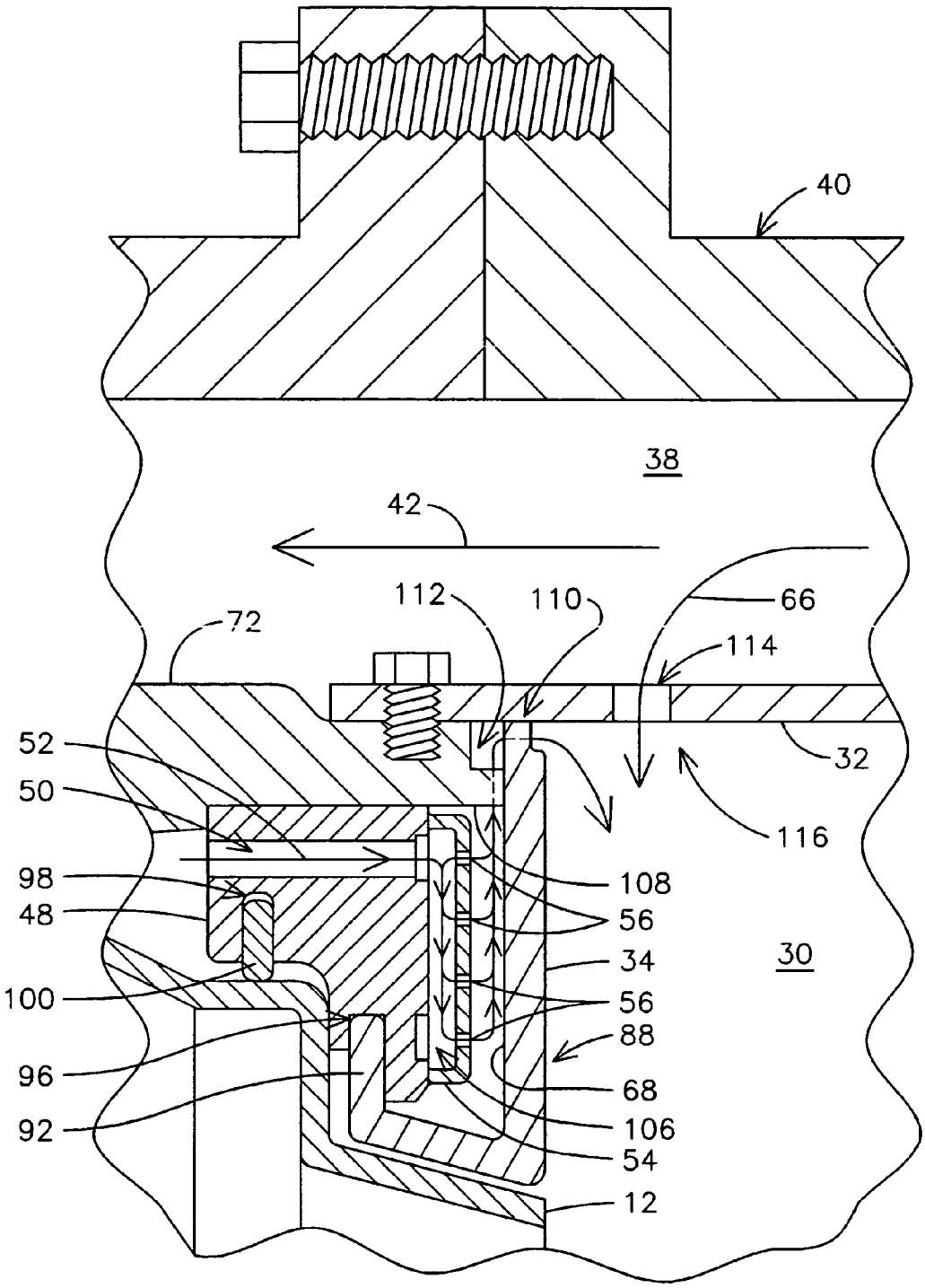
FIG. 7 is a partial cross-sectional view of the gas turbine engine combustor of FIG. 1.

FIG. 7 is a partial cross-sectional view of the combustor of FIG. 1 showing details of the burner insert assembly 88 and oxidizer flows 42, 52, 66 in the vicinity of the burner insert assembly 88. As shown in FIG. 7, the burner insert assembly 88 may be installed around the main burner 12 with a seal 100, such as a split ring, positioned in the seal recess 98 to seal against the main burner 12 and prevent the second portion of the oxidizer flow 52 from flowing between the main burner 12 and the burner insert assembly 88. The mounting lip 92 of the burner insert 34 is supported by the burner insert support 48 in the mounting recess 96. Near the periphery 110 of the burner insert 34, standoff tabs 108 may be provided at a downstream end 112 of the liner support 72 to further support the burner insert 34 and maintain a gap between an upstream face 68 of the burner insert 34 for impingement cooling. In an aspect, the standoff tabs 108 are spaced apart to allow the second portion of the oxidizer flow 52 that has impinged on the burner insert 34 to flow between the downstream end 112 of the liner support 72 and the upstream face 68 of the burner insert 34. For example, the standoff tabs 108 may be circumferentially spaced apart around the downstream end 112 of the liner support 72 so that the standoff 108 tabs support the burner insert 34, and spaces between the standoff tabs 108 allow passage of the second portion of the oxidizer flow 52. The second portion of the oxidizer flow 52 can then flow past the downstream end 112 of the liner support and between the spacing tabs 94 formed in the periphery 110 of the burner insert 34 into the combustion chamber 30 near the upstream end of the combustion chamber liner 32. For example, about 0.3% of the oxidizer flow 42 provided to the combustor 10 may be used in the second portion of the oxidizer flow 52. Experimental tests have demonstrated that this second portion of the oxidizer flow 52 flowing into the combustion chamber 30 appears to help suppress NOx emissions.

The combustor 10 may further feature passageways 114, such as combustor liner openings, in the upstream end 116 of the combustion chamber liner 32 near the periphery 110 of the burner insert 34 for allowing passage of a third portion of the oxidizer flow 66 into the combustion chamber 30. For example, the passageways 114 may be distributed uniformly around the combustion chamber liner 32 near the burner insert 34, or at different distances apart. The passageways 114 may be sized, shaped, and angled to provide a desired flow path through the combustion chamber liner 32 into the combustion chamber 30. Accordingly, the passageways 114 may be configured so that the third portion of the oxidizer flow 66 flowing through the passageways 114 is about 2.0% of the oxidizer flow 42 provided to the combustor 10. Experimental tests have demonstrated that this third portion of the oxidizer flow 66 flowing into the combustion chamber 30 appears to reduce emissions of NOx during the combustion process due, it is believed, to improved dynamic pressure stability.

Figure 8:
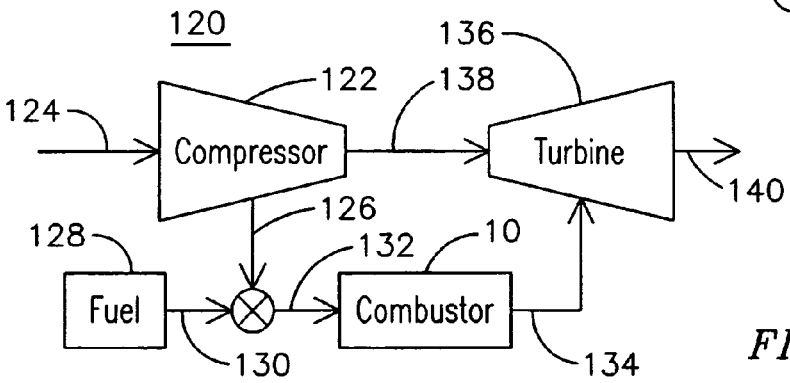
FIG. 8 illustrates a combustion turbine engine including the combustor of FIG. 1.

FIG. 8 illustrates a gas turbine engine 120 featuring the combustor 10 as described above. The gas turbine engine includes a compressor 122 for receiving a flow of filtered ambient air 124 and for producing a flow of compressed air 126. The compressed air 126 is mixed with a flow of a combustible fuel 130, such as natural gas or fuel oil for example, provided by a fuel source 128, to create a fuel-oxidizer mixture flow 132 prior to introduction into the combustor 10. The fuel-oxidizer mixture flow 132 is combusted in the combustor 10 to create a hot combustion gas 136.

A turbine 136, receives the hot combustion gas 134, where it is expanded to extract mechanical shaft power. In one embodiment, a common shaft 138 interconnects the turbine 136 with the compressor 122, as well as an electrical generator (not shown) to provide mechanical power for compressing the ambient air 124 and for producing electrical power, respectively. The expanded combustion gas 140 may be exhausted directly to the atmosphere or it may be routed through additional heat recovery systems (not shown). The gas turbine engine 10 provides improved manufacturing, maintainability and, reduced NOx formation as a result of features of the combustor 10 described above and shown more clearly in FIGS. 1–7.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A combustor comprising:

a cylindrical basket having an axis;

a single main burner assembly disposed within the basket and opening into a combustion chamber;

a burner insert disposed in an annular space between the burner assembly and the basket, the insert having a face exposed to the combustion chamber and perpendicular to the axis of the basket;

a plurality of passageways formed through the basket, for introducing air into the combustion chamber proximate to and downstream of the burner insert;

a fluid flow path defined between a combustion liner portion of the basket and a casing spaced radially outward from the combustion liner portion, the fluid flow path discharging air into a flow reversal region proximate an inlet of the burner assembly; and a fuel outlet disposed in the flow reversal region.

2. The combustor of claim 1, wherein the burner insert further comprises an outside diameter smaller than an inside diameter of the basket so that a gap is formed along at least a portion of a circumference of the burner insert between the burner insert and the basket.

3. The combustor of claim 1, further comprising an insert support for supporting the burner insert, the insert support disposed upstream of the burner insert and protected from exposure to hot combustion products by the burner insert.

4. A combustor comprising:

a cylindrical basket having an axis;

a burner assembly disposed within the basket and separated from the basket by an annular space, the burner assembly configured to discharge a fuel/air mixture into a combustion chamber downstream of the burner assembly;

an annular burner insert disposed in the annular space, the insert having a downstream face exposed to the combustion chamber and perpendicular to the axis of the basket, the insert comprising a generally J-shaped cross section forming a circumferential mounting lip around an inside diameter of the burner insert, the mounting lip oriented radially outward from a central axis of the insert; and an annular insert support for supporting the burner insert, the insert support disposed on a side of the burner insert opposed to the combustion chamber and protected from exposure to hot combustion products by the burner insert, the insert support comprising a circumferential recess formed therein around an inside diameter of the insert support and extending radially outward into the support for receiving the circumferential mounting lip of the burner insert therein, the insert support comprising at least two arcuate portions allowing assembly of the respective portions onto the burner insert and connection of the portions so that the mounting lip is retained within the circumferential recess to allow the burner insert to be removably attached to the insert support for selective replacement.

5. The combustor of claim 4, further comprising a passage formed through the insert support for conveying a fluid to cool the burner insert.

6. The combustor of claim 5, wherein the insert support further comprises an impingement plate defining a plenum for receiving the fluid and further comprising a plurality of holes for directing the fluid to impinge on a face of the burner insert opposed the combustion chamber.

7. The combustor of claim 4, wherein the burner insert further comprises an outside diameter smaller than an inside diameter of the basket so that an annular gap is formed at least along a portion of a circumference of the burner insert between the burner insert and the basket for allowing a fluid to flow into a downstream combustion chamber.

8. The combustor of claim 4, wherein the basket further comprises a plurality of passageways circumferentially positioned proximate to and downstream of the burner insert for allowing air to flow into the combustion chamber proximate the burner insert.

9. A combustor comprising:

a cylindrical basket having an axis;

a burner assembly disposed within the basket and separated from the basket by an annular space, the burner assembly configured to discharge a fuel/air mixture into a combustion chamber downstream of the burner assembly;

a burner insert disposed in the annular space, the insert having a downstream face exposed to the combustion chamber and perpendicular to the axis of the basket;

a fluid flow path defined between at least a portion of the basket and a concentric casing spaced radially away from the basket for directing air in a direction opposite from a direction of flow of the air/fuel mixture through the burner assembly;

a flow reversal region, in fluid communication with the fluid flow path, proximate an inlet of the burner assembly for redirecting the air into the inlet of the burner assembly; and a fuel delivery mechanism disposed in the flow reversal region.

10. The combustor of claim 9, further comprising a liner support, attached to the casing, for attaching a combustor liner to the liner support with removable fasteners.

11. The combustor of claim 10, wherein the liner support further comprises a plurality of standoff tabs to space the burner insert away from a downstream end of the liner support, the standoff tabs spaced apart and extending away from the downstream end of the liner support for allowing air to flow around a downstream end of the liner support between the standoff tabs.

12. A gas turbine combustor comprising:

a cylindrical basket having an axis;

a single main burner assembly disposed within the basket; and a burner insert assembly disposed in an annular space between the burner assembly and the basket, the burner insert assembly further comprising:

an annular burner insert having a face perpendicular to the axis of the basket, the insert comprising a generally J-shaped cross section forming a circumferential mounting lip around an inside diameter of the burner insert, the mounting lip oriented radially outward from a central axis of the insert; and an annular insert support for supporting the burner insert, the insert support protected from exposure to hot combustion products by the burner insert, the insert support comprising a circumferential recess formed therein around an inside diameter of the insert support and extending radially outward into the support for receiving the at least two arcuate portions allowing assembly of the respective portions onto the burner insert and connection of the portions so that the mounting lip is retained within the circumferential recess to allow the burner insert to be removably attached to the insert support for selective replacement.

13. The burner insert assembly of claim 12, further comprising a passage formed through the insert support for conveying a fluid flow from an upstream face of the insert support to a downstream face of the insert support.

14. The burner insert assembly of claim 13 further comprising an impingement plate attached to the downstream face of the burner support, the impingement plate defining a plenum for receiving the fluid flow and further comprising a plurarity of holes for directing the fluid flow to impinge on an upstream face of the burner insert.

15. The burner insert assembly of claim 12, further comprising a ring seal for aligning and sealing the burner insert assembly against the burner assembly.

* * * * *